US006167212A

United States Patent [19]

Satoh et al.

[11] Patent Number: 6,167,212

[45] Date of Patent: Dec. 26, 2000

[54] DEVELOPMENT DENSITY ADJUSTING METHOD FOR IMAGE FORMING APPARATUS

[75] Inventors: Hiroshi Satoh, Moriya-machi; Keiji Okano, Tokyo; Masanobu Saito; Gaku Konishi, both of Kashiwa; Yasushi Shimizu, Toride; Akira Domon, Kashiwa; Satoru Motohashi, Toride, all of Japan

[73] Assignee: Canon Kabushiki Kaisha, Tokyo, Japan

[21] Appl. No.: 09/401,371

[22] Filed: Sep. 22, 1999

[30] Foreign Application Priority Data

Sep. 28, 1998 [JP] Japan ..... 10-273130

[51] Int. Cl.[7] ..... G03G 15/08

[52] U.S. Cl. ..... 399/55; 399/270; 430/120

[58] Field of Search ..... 399/53, 55, 56, 399/285, 270; 430/120, 122; 358/504, 406, 296

[56] References Cited

U.S. PATENT DOCUMENTS

| | | | |
|---|---|---|---|
| 5,338,894 | 8/1994 | Uchiyama et al. | 399/270 |
| 5,521,683 | 5/1996 | Miyamoto et al. | 399/55 |
| 5,937,228 | 8/1999 | Shoji et al. | 399/55 |

FOREIGN PATENT DOCUMENTS 11-109728 4/1999 Japan .

*Primary Examiner*—Sophia S. Chen

*Attorney, Agent, or Firm*—Fitzpatrick, Cella, Harper & Scinto

[57] ABSTRACT

The present invention relates to a development density adjusting method in which development density is adjusted by varying ratio of application time of a voltage having the first voltage value to application time of a voltage having the second voltage value in one period, and difference between a potential of the developer bearing member and a potential of the electrostatic latent image, when the voltage having the first voltage value is applied to the developer bearing member.

24 Claims, 8 Drawing Sheets

DEVELOPMENT DENSITY ADJUSTING METHOD FOR IMAGE FORMING APPARATUS

BACKGROUND OF THE INVENTION

1. Field of the Invention

The present invention relates to a development density adjusting method for an image forming apparatus such as a copying apparatus or a printer, and to an image forming apparatus.

2. Related Background Art

In the copying apparatus or printer of the electrophotographic process, the electrostatic image (electrostatic latent image) formed on a photosensitive member by imagewise exposure (image exposure) thereto has been developed by forming an electric field in the developing area and depositing developer onto the electrostatic image formed on the photosensitive member.

For forming such electric field, there is widely employed a rectangular wave bias voltage obtained by superposing a rectangular wave AC voltage with a DC component, because the rectangular wave can provide a large electric energy with a limited peak voltage.

The developer receives a force from the developer bearing member toward the photosensitive member by a flying voltage component in such bias voltage and also receives a returning force toward the developer bearing member by a returning voltage component, and these processes cause the developer to be deposited onto the electrostatic image on the photosensitive member, thus achieving the development.

Various commercial products utilizing the electrophotographic technology are provided with an image density adjusting device in order to enable the user to obtain a desired image, and such density adjustment is achieved by adjusting the amount of deposition of the developer in the developing process through the control of the bias voltage.

Among the conventional methods for controlling the bias voltage, there is already known a method of varying the magnitude of the DC voltage to be superposed with the rectangular wave AC voltage (conventional example 1).

FIG. 7 shows the level settings of the rectangular wave bias voltage, in the conventional example, for a maximum density F1, a standard density F5 and a minimum density F9, wherein Vmax indicates a development accelerating potential, Vmin indicates a returning potential, VL indicates a light potential corresponding to the image area on the photosensitive member, and Vd is a dark potential corresponding to the non-image area on the photosensitive member. Vpp is the peak-to-peak voltage of the bias voltage, and is always set at 1500 V.

In this method, a higher density image, for example, is obtained by increasing the flying voltage and decreasing the returning voltage, thereby enhancing the flying effect and increasing the deposited amount of the developer onto the photosensitive member.

In the illustrated example, a density increase for example from F5 to F1 is achieved by increasing the flying voltage |Vmax−VL| from 970 V to 1050 V and decreasing the returning voltage |Vmin−VL| from 530 V to 450 V. On the other hand, the development with a lower density is achieved by decreasing the flying voltage and increasing the returning voltage.

However, in such conventional example 1, the flying voltage and the reversal contrast tend to become large since the image density is adjusted by varying the magnitude of the flying voltage and the returning voltage.

For example, in the image development at a high image density, a high flying voltage causes the developer to be deposited only in the image area but also in the non-image area, thus causing so-called background fog (fog on background). Also in the image development at a low image density, the positively charged developer receives a large reversal contrast (difference between the returning potential and the dark potential of the photosensitive member) to result in a significant increase in the reversal fog (see. FIG. 6).

For example the reversal contrast becomes as high as 900 V at F1, 980 V at F5 and 1060 V at F9, thus resulting significant reversal fog at the low density side.

In contrast to such conventional example 1, there is also known a method of varying the image density by varying the ratio of the duration of the returning voltage to that of the flying voltage, while the magnitude of the flying voltage, returning voltage and DC component is fixed in the bias voltage.

In this method, the image density can be increased by extending the duration of the flying voltage with respect to that of the returning voltage, thereby increasing the amount of developer deposited onto the image bearing member.

FIG. 8 shows the settings, as conventional example 2, of the bias voltage for the maximum density F1, standard density F5 and minimum density F9. The potential settings (Vmax=−1300 V, Vmin=200 V, Vpp=−1500 V) are so selected as to allow comparison with the conventional example 1 and the embodiments of the present invention, under similar conditions.

In this method, the duty ratio, indicating the proportion of the duration of the flying voltage, is defined as follows:

$$\text{Duty ratio}=(Ta/(Ta+Tb))\times 100\ (\%) \qquad \text{<Formula 2>}$$

wherein

Ta: duration of flying voltage in a cycle of bias voltage

Tb: duration of returning voltage in a cycle of bias voltage.

The duty ratio is selected as 32.7% for F9; 38% for F5; and 43.3% for F1.

The conventional example 2 can suppress the increase in the background fog or the reversal fog, since the density is adjusted by a change in the duty ratio while the potential settings (Vmax=−1300 V; Vmin=200 V; Vpp=−1500 V) are fixed.

The conventional example 1 tends to result in a high flying voltage or a high reversal contrast, eventually leading to background fog or reversal fog.

On the other hand, the conventional example 2 is expected to provide an image with lower background fog or reversal fog than in the conventional example 1, since the flying voltage and the returning voltage are maintained constant so that the flying voltage or the reversal contrast does not become excessively high. However, as shown in FIG. 6, the conventional example 2 provides little fog at the low density side but shows a certain fog level at the high density side.

It will therefore be understood that the conventional example 2 cannot be the decisive means for sufficiently suppressing the background fog at the high density side, though it provides a higher flying voltage in the conventional example 1.

To catch the problem again, we will refer to the relation between the dimension of the difference between the flying voltage and the potential of the electrostatic image, and the ratio of the duration of the flying voltage to the duration of the returning voltage, referring to the wave form of the bias voltage.

In the wave form of the bias voltage, the area of the flying voltage can be defined, in the vertical direction, by the difference between the flying voltage and the potential of the electrostatic image and, in the horizontal direction, by the duration of the flying voltage. In the conventional example 1, the area at the level F1 is given by 1050 V in the vertical direction and 50% in the horizontal direction, while that in the conventional example 2 at the level F1 is given by 1150 V in the vertical direction and 43.3% in the horizontal direction. The amount of the developer flying to the photosensitive member is proportional to such area.

Referring to FIG. 6, the vertical magnitude of the wave form influences the fog more than the horizontal magnitude since the two conventional technologies provide a same image density but the conventional example 2 provides a higher fog level. Stated differently, for a same area of the flying voltage, namely for a same image density, a horizontally oblong wave form, with a reduced difference between the flying voltage and the potential of the electrostatic image and a longer duration of the flying voltage, is effective for suppressing the fog.

An increase in the image density is considered to be achieved, in the conventional example 1, by increasing the difference in the vertical direction between the flying voltage and the potential of the electrostatic image, but, in the conventional example 2, by extending the duration of the flying voltage in the horizontal direction. However a lower fog level can be obtained in the conventional example 2 than in the conventional example 1, because, as described above, the fog can be more effectively suppressed by reducing the difference between the flying voltage and the potential of the electrostatic image and extending the duration of the flying voltage.

However the increase of the developed density by extending the duration of the flying voltage in the horizontal direction alone is still insufficient, because, as shown in FIG. 6, the conventional example 2 still generates fog at the high density side.

SUMMARY OF THE INVENTION

An object of the present invention is to provide a development density adjusting method capable of adjusting the development density, while maintaining high image quality, and an image forming apparatus suitable for realizing such method.

Another object of the present invention is to provide a development density adjusting method capable of adjusting the development density, while preventing fog generation, and an image forming apparatus suitable for realizing such method.

Still another object of the present invention is to provide a development density adjusting method for an image forming apparatus, comprising steps of:

forming a development area by opposing a developer bearing member bearing developer to an image bearing member bearing an electrostatic latent image;

applying a voltage to the developer bearing member, wherein a value of the voltage periodically includes a first voltage value for forming an electric field adapted to direct the developer in a direction toward the image bearing member in the development area, and a second voltage value for forming an electric field adapted to direct the developer in a direction away from the image bearing member in the development area; and adjusting development density by varying ratio of application time of a voltage having the first voltage value to application time of a voltage having the second voltage value in one period, and difference between a potential of the developer bearing member and a potential of the electrostatic latent image, when the voltage having the first voltage value is applied to the developer bearing member.

Still another object of the present invention is to provide an image forming apparatus, comprising:

a) an image bearing member for bearing an electrostatic latent image;

b) a developer bearing member opposed to the image bearing member to form a developing area; and c) voltage application means for applying a voltage to the developer bearing member, a value of the voltage periodically including a first voltage value for forming an electric field adapted to direct the developer in a direction toward the image bearing member in the development area, and a second voltage value for forming an electric field adapted to direct the developer in a direction away from the image bearing member in the development area;

wherein the development density is adjusted by varying ratio of application time of a voltage having the first voltage value to application time of a voltage having the second voltage value in one period, and difference between a potential of the developer bearing member and a potential of the electrostatic latent image, when the first voltage value is applied to the developer bearing member.

Still other objects of the present invention, and the features thereof, will become fully apparent from the following detailed description to be taken in conjunction with the attached drawings.

DESCRIPTION OF THE PREFERRED EMBODIMENTS

[Embodiment 1]

Figure 1:
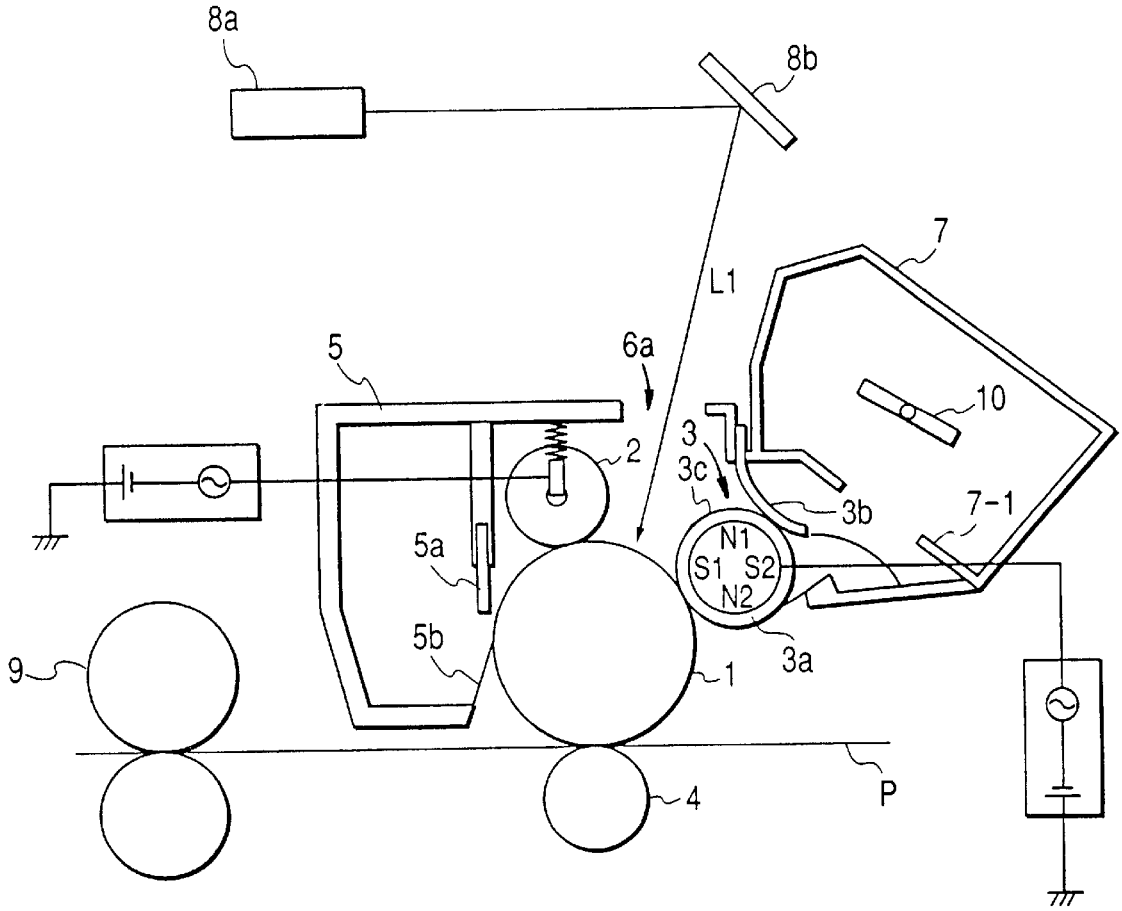
FIG. 1 is a view showing an example of the basic mechanical configuration embodying the present invention.

FIG. 1 shows an example of the basic mechanical configuration, wherein shown are a process cartridge including a photosensitive member 1 serving as an image bearing member for bearing an electrostatic latent image, a charging roller 2, a developing device 3, having a developing sleeve 3*a*, a developing blade 3*b* and a magnet roller 3*c* and a cleaning device 5, having a cleaning blade 5*a* and a receiving sheet 5*b*, as a compact unit which is detachably attachable to the main body of an image forming apparatus; a transfer device 4; a developer container 7 with a stirring rod 10 and an outlet 7-1; and a fixing device 9 and a sheet path p. A window 6*a* is provided for exposing the photosensitive member to an optical image.

The image bearing member 1, charged uniformly by the charging roller 2 at a predetermined potential (about−600 V), is irradiated with a laser beam L1 emitted from exposure means 8*a* through the exposure window 6*a* via a mirror 8*b* to form an electrostatic image (with the potential of image area about −150 V). The developing sleeve 3*a* constituting a developer bearing member, positioned in the developing device 3 in an opposed relationship to the image bearing member 1 and containing therein the multi-pole magnet roller 3*c*, is given a voltage (for example a superposed voltage of a DC voltage and an AC voltage) to form an electric field in the developing area thereby directing negatively charged developer and depositing it onto the electrostatic image on the image bearing member 1.

The developer deposited on the electrostatic image is transferred onto a recording material conveyed in synchronization with the rotation of the transfer roller 4. After the transfer, the recording material is conveyed to the fixing device 9 and is subjected therein to image fixation.

Figure 2:
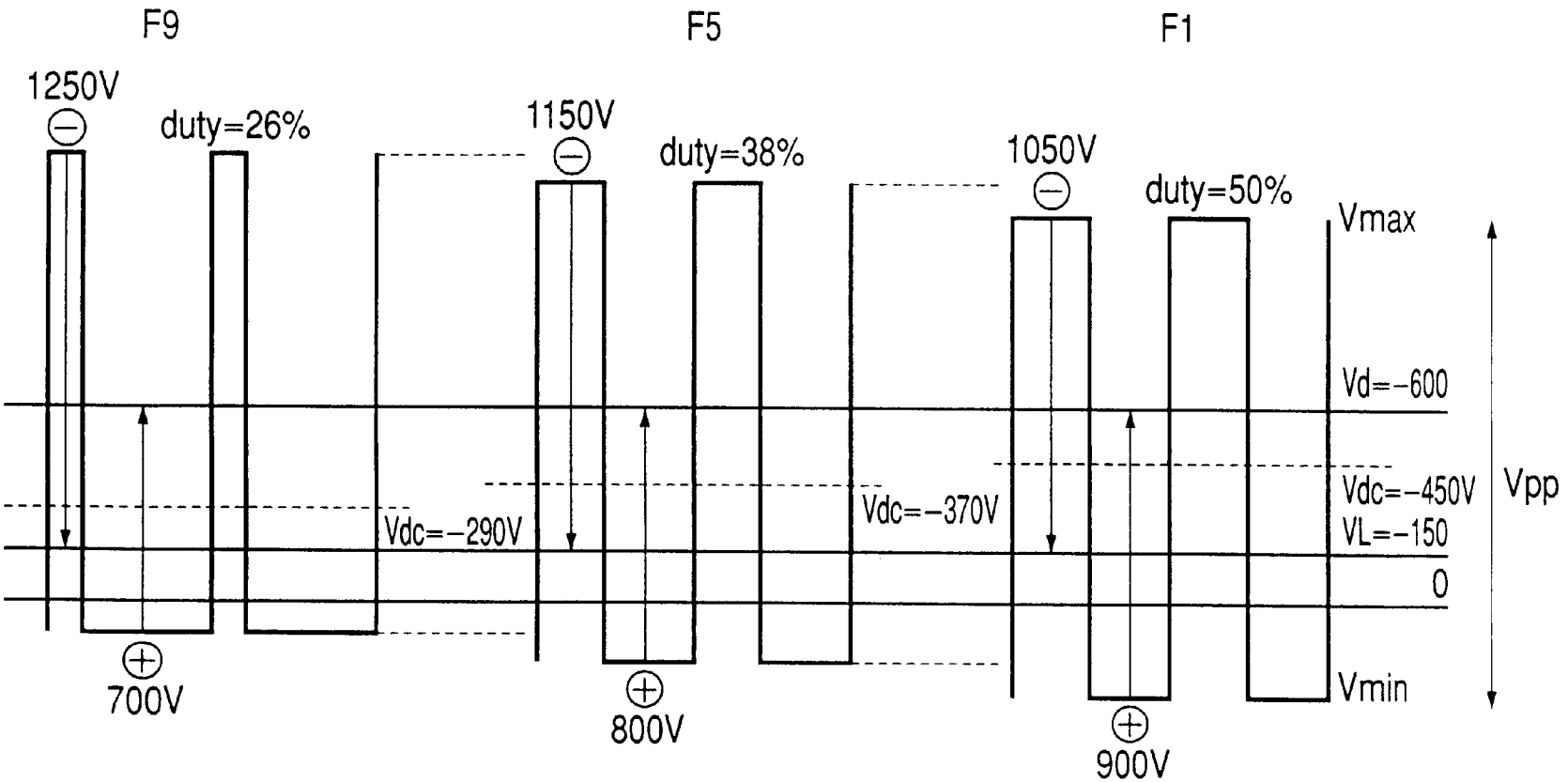
FIG. 2 is a chart showing the potential setting in an example 1 of the present invention.

FIG. 2 shows the bias voltage in the example 1 at a maximum density F1, a standard density F5 and a minimum density F9. As shown in FIG. 2, the bias voltage periodically has a first voltage value for forming an electric field in the developing area for directing the developer toward the image bearing member 1 and a second voltage value for forming an electric field in the developing area for directing the developer away from the image bearing member 1. The duty ratio and the time-averaged value Vdc of the bias voltage are defined as follows:

$$\text{Duty ratio}=(Ta/(Ta+Tb))\times 100\ (\%) \qquad \text{<Formula 2>}$$

wherein

Ta: duration of flying voltage (voltage having first voltage value) in a cycle of bias voltage Tb: duration of returning voltage (voltage having second voltage value) in a cycle of bias voltage $$Vdc=Vmax\times a/100+Vmin\times(1-a/100)$$

wherein a: duty ratio (%)

Vmax: flying voltage

Vmin: returning voltage

Also Vd indicates the dark potential corresponding to the non-image area of the photosensitive member, and VL indicates the light potential corresponding to the image area of the photosensitive member. The potential settings at different F levels in the present example and in the conventional example are shown in the following table. Also there are defined:

$$\text{flying contrast}=|Vmax-VL|$$

$$\text{background fog contrast}=|Vmax-Vd|$$

$$\text{reversal contrast}=|Vmin-Vd|$$

TABLE 1

| Vpp | | Embodiment 1 1.5kV | Conventional example 1 1.5kV | Conventional example 2 1.5kV |
|---|---|---|---|---|
| Duty ratio | F9 | 26% | 50% | 32.7% |
| | F5 | 38% | 50% | 38.0% |
| | F1 | 50% | 50% | 43.3% |
| Vdc | F9 | 290V | 290V | 290V |
| | F5 | 370V | 370V | 370V |
| | F1 | 450V | 450V | 450V |
| flying contrast | F9 | 1250V | 890V | 1150V |
| | F5 | 1150V | 970V | 1150V |
| | F1 | 1050V | 1050V | 1150V |
| background fog contrast | F9 | 800V | 440V | 700V |
| | F5 | 700V | 520V | 700V |
| | F1 | 600V | 600V | 700V |
| reversal contrast | F9 | 700V | 1060V | 800V |
| | F5 | 800V | 980V | 800V |
| | F1 | 900V | 900V | 800V |

For the purpose of comparison with the aforementioned conventional example, the potential is selected at the level F5 same as that in the conventional example 2 and at the level F1 same as that in the conventional example 1, and the peak-to-peak voltage Vpp of the bias voltage is fixed at 1500 V in all the cases.

In the present embodiment, the flying voltage decrease from 1250 V through 1150 V to 1050 V as the density level shifts from the low density limit F9 through the standard density F5 to the high density limit F1, but the image density is elevated by increasing the duty ratio from 26% through 38% to 50%.

As explained in the foregoing, the increase in the image density is achieved by increasing the ratio of the duration of the flying voltage in the bias voltage to that of the returning voltage, and decreasing the difference between the flying voltage and the returning voltage.

Figure 6:
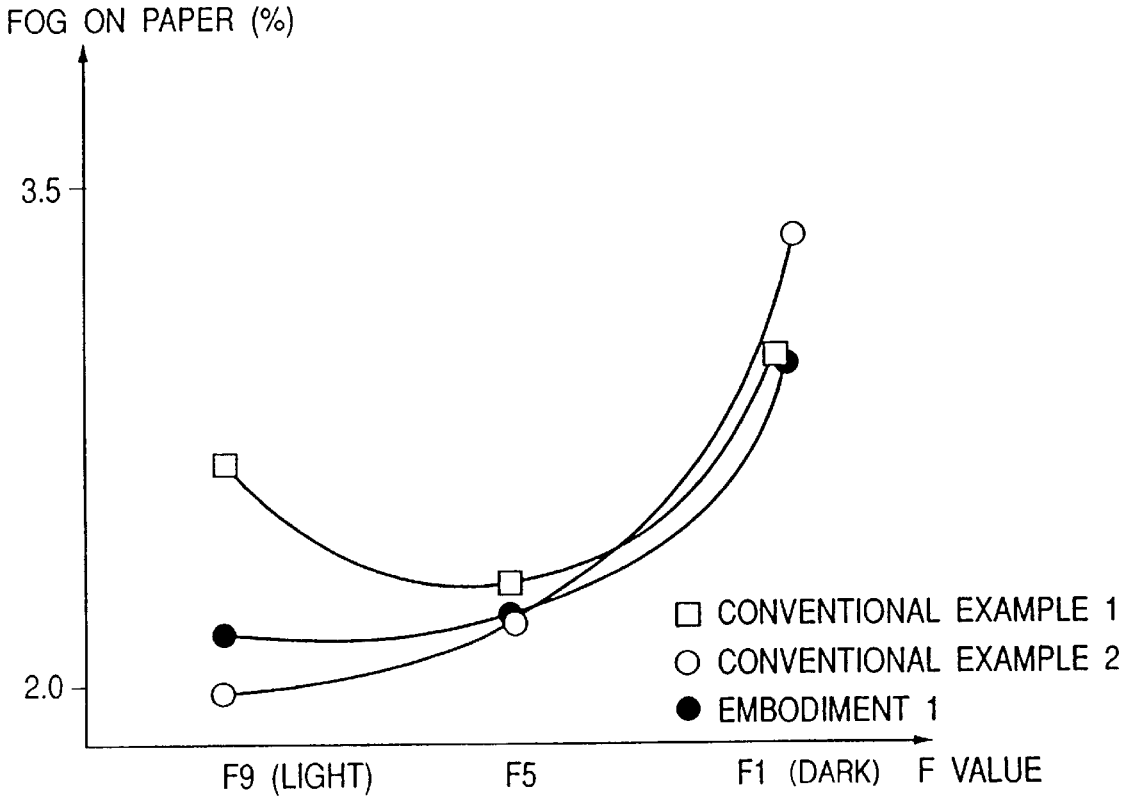
FIG. 6 is a chart showing fog on paper at each F value in the conventional example and the example 1.
Figure 7:
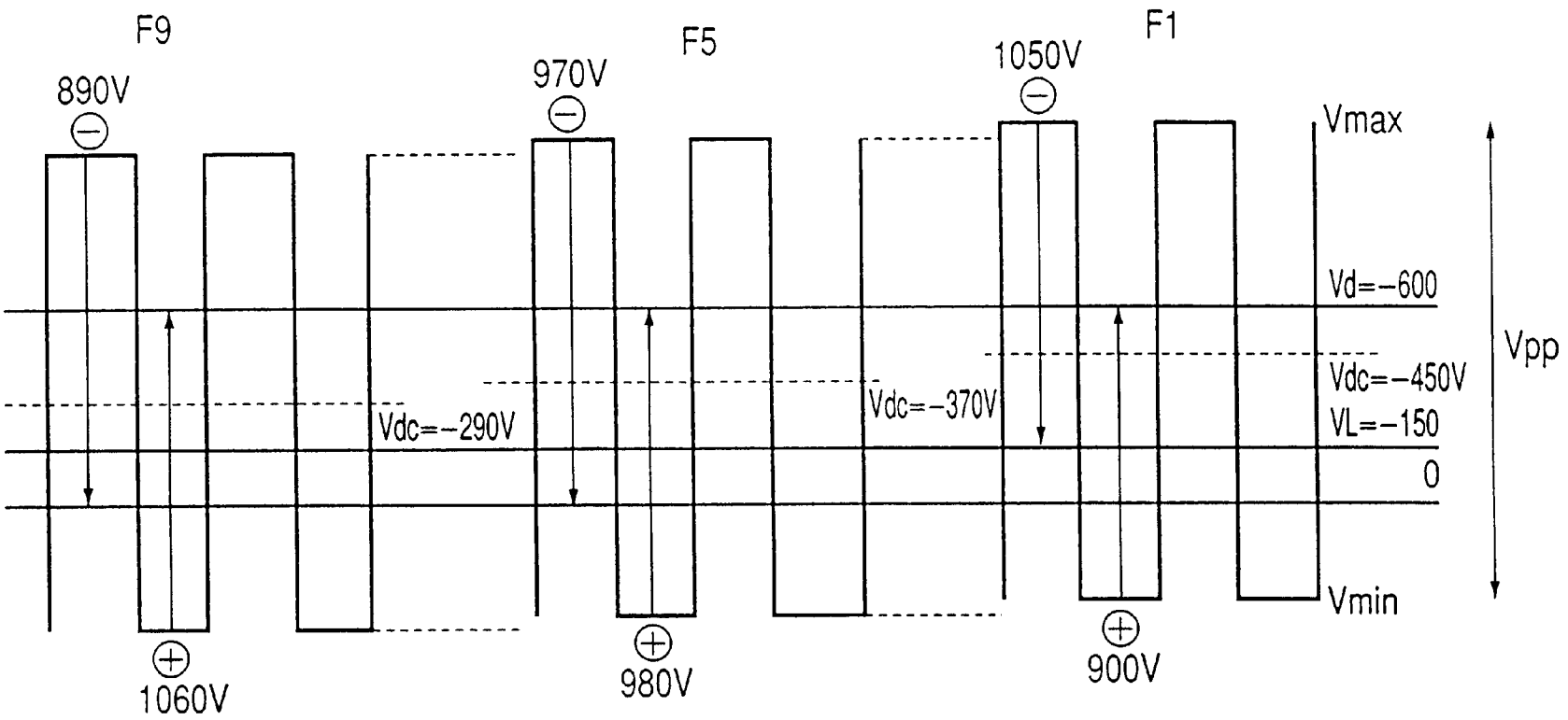
FIG. 7 PRIOR ART
FIG. 7 is a chart showing the potential setting in the conventional example 1.
Figure 8:
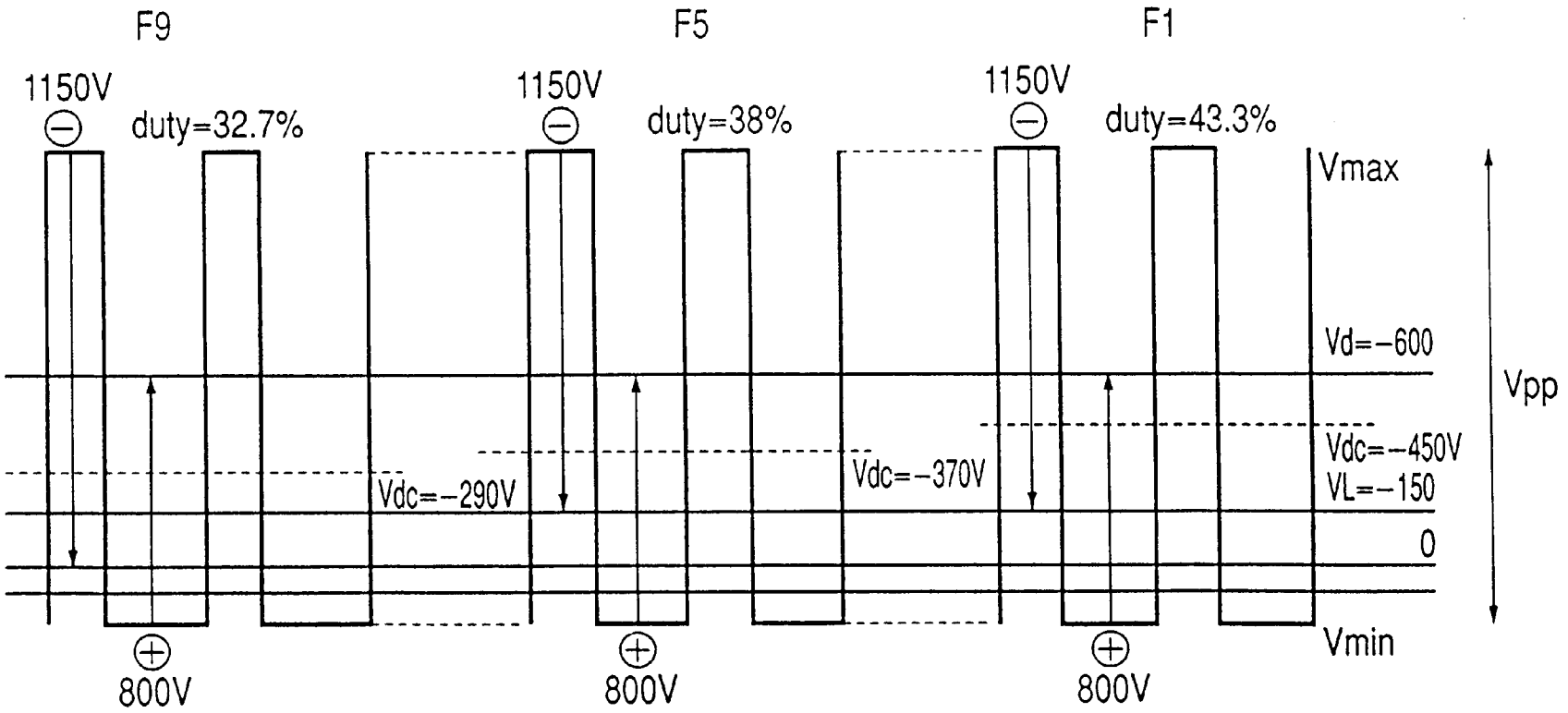
FIG. 8 PRIOR ART
FIG. 8 is a chart showing the potential setting in the conventional example 2.

From the fog levels at different density settings shown in FIG. 6, it will be observed that the present example shows reduced fog more than in the conventional example 2 particularly at the high density side.

Figure 4:
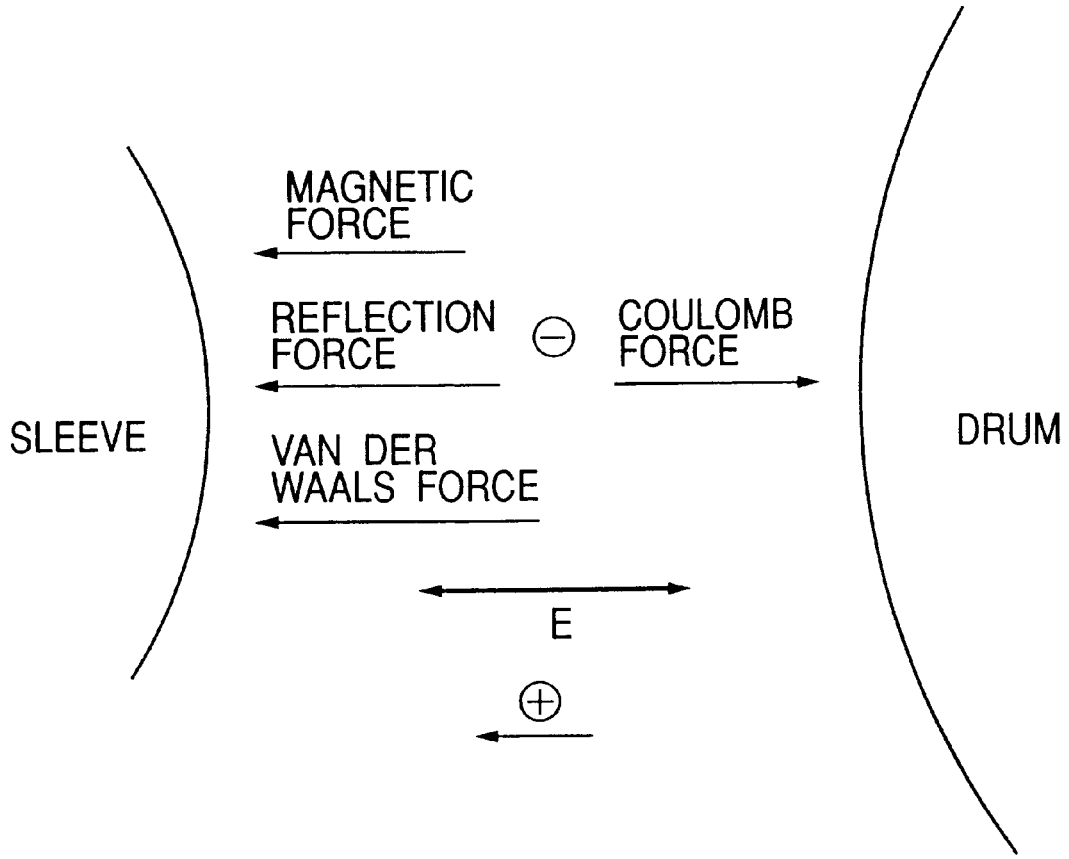
FIG. 4 is a schematic view showing forces received by the developer between the developing member and the image bearing member.

FIG. 4 shows principal forces acting on the developer between the developing member and the photosensitive member. The developer present on the charged developing member flies toward the electrostatic image formed on the photosensitive member, under the force of the electric field etc. between the developing member and the photosensitive member.

The force of the electric field E is generally dominant for the charged developer, but a higher electric field is being desired recently because the influence of the reflection force on the developer deposition has become larger for the recent developer of smaller particles. On the other hand, such large flying voltage induces developer deposition not only in the image area but also in the non-image area, thus resulting in so-called background fog.

In the comparison of fog in the present embodiment and the conventional example 1, the present embodiment 1 shows lower background fog level because, though the flying voltage is higher than in the conventional example 1 at the low density side, the flying amount itself of the developer is smaller due to the smaller duty ratio. On the other hand, the present embodiment shows low reversal fog because of the small reversal contrast (difference between the returning potential and the dark potential of the photosensitive member) and the reversal fog becomes lower than in the conventional example 1 toward the low density side.

As a result, the fog represented by the sum of the background fog and the reversal fog decreases.

In the following there will be explained a specific example of the method for elevating the density.

The flying amount of the developer from the developer bearing member to the image bearing member is proportional to the area of the wave form of the aforementioned bias voltage at the flying voltage side, while the amount of the developer returning from the image bearing member is also proportional to the area of the wave form at the returning voltage side. Thus the amount of the developer deposited on the electrostatic image of the image bearing member, namely the image density, is determined in proportion to the ratio of the area of the flying voltage side to that of the returning voltage side.

Therefore, the image development with a higher density can be achieved by increasing the ratio of the area of the flying voltage side to that of the returning voltage.

In the following there will be explained the setting method for the developing density.

Figure 5:
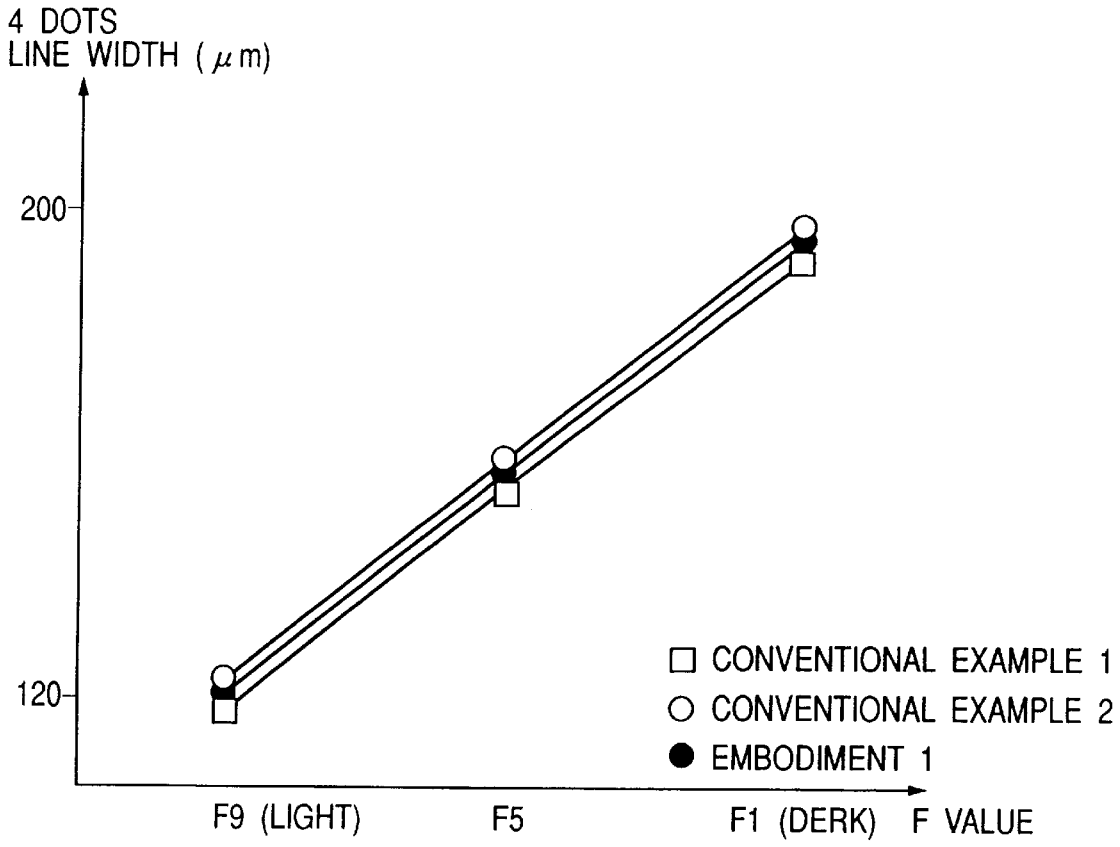
FIG. 5 is a chart showing the width of a 4-dot line at each F value (level) in an image quality of 600 dpi in the conventional example and the example 1.

In general, a change in the density varies the line width of the image. Consequently the level of density control can be known by measuring the line width. FIG. 5 is a chart showing the width of a 4-dot line at each F value in an image of 600 dpi as a function of the density level, in the present embodiment and the conventional examples. This chart indicates that the line width is substantially same in the embodiment 1, conventional examples 1 and 2. This result is derived from a fact that the time averaged bias voltage Vdc is maintained same in all these cases.

The time averaged bias voltage Vdc is represented by:

$$Vdc=Vmax\times a/100+Vmin\times(1-a/100) \quad \text{<Formula 2>}$$

wherein a: duty ratio (%)

Vmax: flying voltage

Vmin: returning voltage.

In any development density adjusting method, the image density itself is determined by the time averaged bias voltage Vdc, irrespective of the differences in the flying voltage and in the duration thereof.

Consequently the image density is determined by Vdc.

[Embodiment 2]

Since a variation of the duty ratio of the present invention is larger in comparison with the conventional example 2, satisfactory image development may become very difficult as the duration of the flying voltage may become too short at the low density side and the direction of the electric field may change before the developer can be deposited on the photosensitive member, for example in case the density variable range is large or the frequency of the bias voltage is high.

In the following there will be explained an embodiment 2 for preventing such phenomenon.

Figure 3:
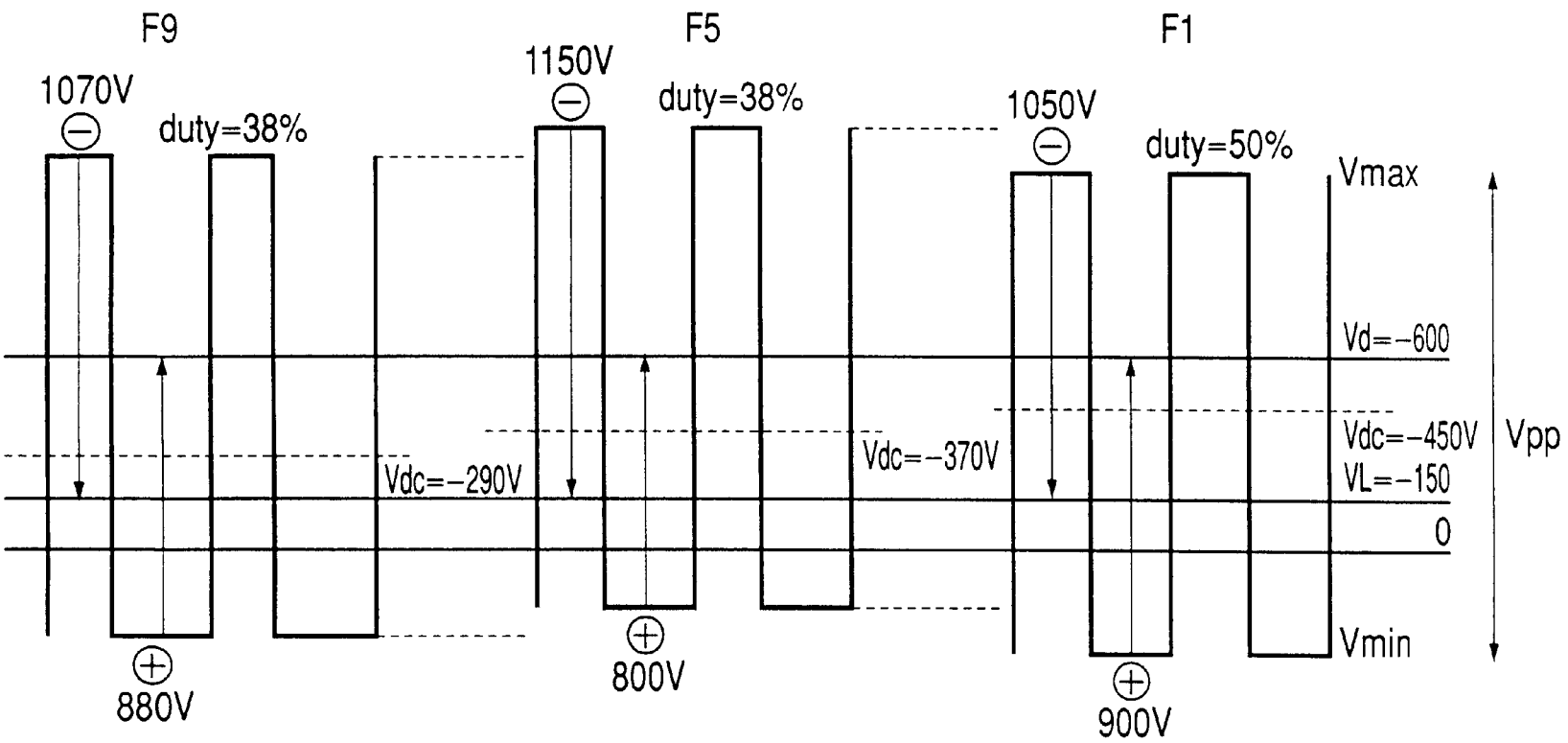
FIG. 3 is a chart showing the potential setting in an example 2 of the present invention.

FIG. 3 shows the bias voltage at the maximum density F1, standard density F5 and minimum density F9 in the present example.

In the present example, the potential setting from F5 to F1 is same as in the embodiment 1, but, from F5 to F9 the density is lowered by decreasing the flying voltage while maintaining the duty ratio constant at 38%. Accordingly, the necessary flying time for the developer can be secured, without unexpected decrease of the duty ratio.

The bias voltage setting in the present embodiment is shown, together with that of other embodiment and conventional examples, in Table 2.

TABLE 2

| Vpp | | Embodiment 2 1.5kV | Embodiment 1 1.5kV | Conventional example 1 1.5kV | Conventional example 2 1.5kV |
|---|---|---|---|---|---|
| Duty ratio | F9 | 38% | 26% | 50% | 32.7% |
| | F5 | 38% | 38% | 50% | 38.0% |
| | F1 | 50% | 50% | 50% | 43.3% |
| Vdc | F9 | 290V | 290V | 290V | 290V |
| | F5 | 370V | 370V | 370V | 370V |
| | F1 | 450V | 450V | 450V | 450V |
| flying voltage | F9 | 1070V | 1250V | 890V | 1150V |
| | F5 | 1150V | 1150V | 970V | 1150V |
| | F1 | 1050V | 1050V | 1050V | 1150V |
| back-ground fog | F9 | 620V | 800V | 440V | 700V |
| | F5 | 700V | 700V | 520V | 700V |
| | F1 | 600V | 600V | 600V | 700V |
| contrast reversal contrast | F9 | 880V | 700V | 1060V | 800V |
| | F5 | 800V | 800V | 980V | 800V |
| | F1 | 900V | 900V | 900V | 800V |

In the present embodiment, the reversal contrast (difference between the returning potential and the dark potential of the photosensitive member) at the density level F9 (980 V) is larger than that (700 V) in the embodiment 1, but the present embodiment is superior to the conventional example 1 in the reversal fog, because the reversal contrast is significantly lower at the high density side than that (1060 V) in the conventional example 1.

Also, in the embodiment 2, the flying voltage (1070 V) at the density level F9 in the density level F9 is selected smaller than that (1250 V) of the embodiment 1. Such setting is effective in case the flying voltage cannot be made very large, for example in order to prevent discharge phenomenon between the image bearing member and the developing member.

The present invention is also applicable to the two-component developer consisting of toner and carrier, but is particularly effective in case the reversal fog is to be avoided in the use of one-component developer consisting solely of toner.

The present invention is effective not only in so-called reversal development for depositing the developer in the low potential area of the image bearing member but also in so-called normal development for depositing the developer in the high potential area of the image bearing member.

The present invention allows to suppress the fog over the density variable range, and to provide an image with reduced fog particularly in the high density level.

It is also rendered possible to prevent unexpected decrease of the duty ratio at the low density side, thereby securing the necessary flying time for the developer, with scarce increase in the fog.

As explained in the foregoing, the embodiments of the present invention provide a development density adjusting method for an image forming apparatus, comprising steps of:

forming a development area by opposing a developer bearing member bearing developer to an image bearing member bearing an electrostatic latent image;

applying a voltage to the developer bearing member, wherein a value of the voltage periodically includes a first voltage value for forming an electric field adapted to direct the developer in a direction toward the image bearing member in the development area, and a second voltage value for forming an electric field adapted to direct the developer in a direction away from the image bearing member in the development area; and adjusting development density by varying ratio of application time of a voltage having the first voltage value to application time of a voltage having the second voltage value in one period, and difference between a potential of the developer bearing member and a potential of the electrostatic latent image, when the voltage having the first voltage value is applied to the developer bearing member.

Also, in increasing the development density, the ratio of the application time of the voltage having the first voltage value to the application time of the voltage having the second voltage value in the one period is increased.

Also, in increasing the development density, the difference between the potential of the developer bearing member and that of the electrostatic latent image, when the voltage having the first voltage value is applied to the developer bearing member, is decreased.

Also, the difference between the first voltage value and the second voltage value is maintained constant in the adjusting step of the development density.

Also, in decreasing the development density from a predetermined level, the difference between the potential of the developer bearing member and that of the electrostatic latent image, when the voltage having the first voltage value is applied to the developer bearing member is decreased while the ratio of the application time of the voltage having the first voltage value to the application time of the voltage having the second voltage value in the one period is maintained constant.

Also, in the image forming apparatus of the present invention, there is executed the adjustment of the development density as described above.

What is claimed is:

1. A development density adjusting method for an image forming apparatus, comprising steps of:

forming a development area by opposing a developer bearing member bearing developer to an image bearing member bearing an electrostatic latent image;

applying a voltage to said developer bearing member, wherein a value of said voltage periodically includes a first voltage value for forming an electric field adapted to direct the developer in a direction toward said image bearing member in the development area, and a second voltage value for forming an electric field adapted to direct the developer in a direction away from said image bearing member in the development area; and adjusting development density by varying ratio of application time of a voltage having said first voltage value to application time of a voltage having said second voltage value in one period, and difference between a potential of said developer bearing member and a potential of said electrostatic latent image, when the voltage having said first voltage value is applied to said developer bearing member;

wherein, in increasing the development density, the ratio of the application time of the voltage having said first voltage value to the application time of the voltage having said second voltage value in the one period is increased.

2. A development density adjusting method according to claim 1, wherein, in increasing the development density, the difference between the potential of said developer bearing member and that of said electrostatic latent image, when the voltage having said first voltage value is applied to said developer bearing member, is decreased.

3. A development density adjusting method according to claim 2, wherein the difference between said first voltage value and said second voltage value is maintained constant in said adjusting step of the development density.

4. A development density adjusting method according to claim 1, wherein, in decreasing the development density from a predetermined level, the difference between the potential of said developer bearing member and that of said electrostatic latent image, when the voltage having said first voltage value is applied to said developer bearing member is decreased while the ratio of the application time of the voltage having said first voltage value to the application time of the voltage having said second voltage value in said one period is maintained constant.

5. A development density adjusting method according to claim 1, wherein the developer is deposited to a low potential area of the electrostatic latent image on said image bearing member.

6. A development density adjusting method according to claim 1, wherein said developer is one-component developer.

7. An image forming apparatus, comprising:

a) an image bearing member for bearing an electrostatic latent image;

b) a developer bearing member opposed to said image bearing member to form a development area; and c) voltage application means for applying a voltage to said developer bearing member, a value of said voltage periodically including a first voltage value for forming an electric field adapted to direct developer in a direction toward said image bearing member in the development area, and a second voltage value for forming an electric field adapted to direct the developer in a direction away from said image bearing member in the development area;

wherein a development density is adjusted by varying ratio of application time of a voltage having said first voltage value to application time of a voltage having said second voltage value in one period, and difference between a potential of said developer bearing member and a potential of said electrostatic latent image, when said first voltage value is applied to said developer bearing member, and wherein, in increasing the development density, the ratio of the application time of the voltage having said first voltage value to the application time of the voltage having said second voltage value in the one period is increased.

8. An image forming apparatus according to claim 7, wherein, in increasing the development density, the difference between the potential of said developer bearing member and that of said electrostatic latent image, when the voltage having said first voltage value is applied to said developer bearing member, is decreased.

9. An image forming apparatus according to claim 8, wherein the difference between said first voltage value and said second voltage value is maintained constant in said adjusting step of the development density.

10. An image forming apparatus according to claim 7, wherein, in decreasing the development density from a predetermined level, the difference between the potential of said developer bearing member and that of said electrostatic latent image, when the voltage having said first voltage value is applied to said developer bearing member is decreased while the ratio of the application time of the voltage having said first voltage value to the application time of the voltage having said second voltage value in said one period is maintained constant.

11. An image forming apparatus according to claim 7, wherein the developer is deposited to a low potential area of the electrostatic latent image on said image bearing member.

12. An image forming apparatus according to claim 7, wherein said developer is one-component developer.

13. A development density adjusting method for an image forming apparatus, comprising steps of:

forming a development area by opposing a developer bearing member bearing a one component developer to an image bearing member bearing an electrostatic latent image;

applying a voltage to said developer bearing member, wherein a value of said voltage periodically includes a first voltage value for forming an electric field adapted to direct the one component developer in a direction toward said image bearing member in the development area, and a second voltage value for forming an electric field adapted to direct the one component developer in a direction field adapted to direct the one component developer in a direction away from said image bearing member in the development area; and adjusting development density by varying ratio of application time of a voltage having said first voltage value to application time of a voltage having said second voltage value in one period, and difference between a potential of said developer bearing member and a potential of said electrostatic latent image, when the voltage having said first voltage value is applied to said developer bearing member.

14. A development density adjusting method according to claim 13, wherein, in increasing the development density, the ratio of the application time of the voltage having said first voltage value to the application time of the voltage having said second voltage value in the one period is increased.

15. A development density adjusting method according to claim 14, wherein, in increasing the development density, the difference between the potential of said developer bearing member and that of said electrostatic latent image, when the voltage having said first voltage value is applied to said developer bearing member, is decreased.

16. A development density adjusting method according to claim 15, wherein the difference between said first voltage value and second voltage value is maintained constant in said adjusting step of the development density.

17. A development density adjusting method according to claim 13, wherein, in decreasing the development density from a predetermined level, the difference between the potential of said developer bearing member and that of said electrostatic latent image, when the voltage having said first voltage value is applied to said developer bearing member is decreased while the ratio of the application time of the voltage having said first voltage value to the application time of the voltage having said second voltage value in said one period is maintained constant.

18. A development density adjusting method according to claim 13, wherein the developer is deposited to a low potential area of the electrostatic latent image on said image bearing member.

19. An image forming apparatus, comprising;

an image bearing member for bearing an electrostatic latent image;

a) a developer bearing member opposed to said image bearing member to form a development area; and b) voltage application means for applying a voltage to said developer bearing member, a value of said voltage periodically including a first voltage value for forming an electric field adapted to direct a one component developer in a direction toward said image bearing member in the development area, and a second voltage value for forming an electric field adapted to direct the one component developer in a direction away from said image bearing member in the development area;

wherein the development density is adjusted by varying ratio of application time of a voltage having said first voltage value to application time of a voltage having said second voltage value in one period, and difference between a potential of said developer bearing member and a potential of said electrostatic latent image, when said first voltage value is applied to said developer bearing member.

20. An image forming apparatus according to claim 19, wherein, in increasing the development density, the ratio of the application time of the voltage having said first voltage value to the application time of the voltage having said second voltage value in the one period is increased.

21. An image forming apparatus according to claim 20, wherein, in increasing the development density, the difference between the potential of said developer bearing member and that of said electrostatic latent image, when the voltage having said first voltage value is applied to said developer bearing member, is decreased.

22. An image forming apparatus according to claim 21, wherein the difference between said first voltage value and said second voltage value is maintained constant in said adjusting step of the development density.

23. An image forming apparatus according to claim 19, wherein, in decreasing the development density from a predetermined level, the difference between the potential of said developer bearing member and that of said electrostatic latent image, when the voltage having said first voltage value is applied to said developer bearing member is decreased while the ratio of the application time of the voltage having said first voltage value to the application time of the voltage having said second voltage value in said one period is maintained constant.

24. An image forming apparatus according to claim 19, wherein the developer is deposited to a low potential area of the electrostatic latent image on said image bearing member.

* * * * *

UNITED STATES PATENT AND TRADEMARK OFFICE

CERTIFICATE OF CORRECTION

PATENT NO. : 6,167,212
DATED : December 26, 2000
INVENTOR(S) : Hiroshi Satoh, et al.

It is certified that error appears in the above-identified patent and that said Letters Patent is hereby corrected as shown below:

Sheet 5,
FIG. 5, "(DERK)" should read as -- (DARK) --.

Column 5,
Line 6, "p." should read -- P. --; and
Line 47, "Vdc=Vmax×α/100+Vmin×(1-α/100)" should read -- Vdc=V max ×α/100+Vmin ×(1-α/100) <Formula 3> --.

Column 7,
Line 31, "<Formula 2>" should read -- <Formula 4> --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*